US006312271B1

(12) United States Patent
Tseng

(10) Patent No.: US 6,312,271 B1
(45) Date of Patent: Nov. 6, 2001

(54) CONNECTOR HAVING FOLDABLE PLUG

(75) Inventor: Kuo-Liang Tseng, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 09/803,278

(22) Filed: Mar. 9, 2001

(51) Int. Cl.[7] ..... H01R 13/44
(52) U.S. Cl. ..... 439/131; 439/172
(58) Field of Search ..... 439/131, 172, 439/173, 174, 518, 52, 104

(56) References Cited

U.S. PATENT DOCUMENTS 4,997,381 * 3/1991 Oh ..... 439/131 X
5,494,449 * 2/1996 Chioo ..... 439/131 X
5,613,863 * 3/1997 Klaus et al. ..... 439/131
5,967,807 * 10/1999 Wu ..... 439/131
6,089,886 * 7/2000 Mareno ..... 439/131
6,126,460 * 10/2000 Wu ..... 439/131

* cited by examiner

*Primary Examiner*—Brian Sircus
*Assistant Examiner*—Son V. Nguyen
(74) *Attorney, Agent, or Firm*—Klein & Szekeres, LLP

(57) ABSTRACT

A structure of a connector for connecting a power supply to a power-receiving device is provided. The connector includes an upper housing, a foldable plug, an orientating base, a circuit board and a lower housing. The pins of the plug are electrically connected with the circuit board when the plug is folded to a first position, and the pins are disconnected with the circuit board when the plug is folded to a second position.

10 Claims, 7 Drawing Sheets

CONNECTOR HAVING FOLDABLE PLUG

FIELD OF THE INVENTION

The present invention relates to a connector, and more particularly to a connector having a foldable plug.

BACKGROUND OF THE INVENTION

An electrical connector principally includes an insulating housing, a plug and a circuit mounted within the housing. The plug is used to accept power supplied by an external power source and deliver the power to the circuit. The arrangement of the circuit is dependent on the function of the connector, for example being as an adapter or a charger, to perform rectification or conversion for a power-receiving device. The plug of a typical connector usually has two conducting pins projected from one side of the housing. When the connector is not in use, a man is easy to get hurt by the tips of projected pins. Thus, a connector having a foldable plug has been developed. FIGS. 1(*a*) and 1(*b*) show the perspective view and cross-sectional view of a typical connector having a foldable plug. Such connector includes a housing 10 and a plug 11. The housing further has a concave storage confinement 12 near the top edge of the housing 10. The plug 11 is mainly composed of a rod 111 having a tenon 114 on each side thereof, two first pins 112 and two second pins 113. The first pins 112 and the second pins 113 respectively have holes 115 and 116 corresponding to the tenon 114 for inserting the tenon 114 to make the connection of the first pins 112, the second pins 113 and the rod 111. Each side wall of the concave storage confinement 12 has a spring receptacle 121 containing a spring 122. The ends of the spring 122 are respectively in contact with a side of the spring receptacle 121 and a cavity 117 disposed in each of the first pins 112 via a fixing element 123. The plug is positioned in the concave storage confinement 12 by the resilience force of the springs 122 and folded by adjusting the first pins to drive the second pins and rotate the rod 111. Thus, the plug 11 is electrically connected to the circuit mounted inside the housing 11.

Although the above mentioned connector has a foldable plug, the connector still has the following drawbacks:

1. Five elements, i.e. one rod 111, two first pins 112, two second pins, are required for assembling the plug 10; furthermore, assembling the connector further needs two springs 122, two fixing elements 123, one upper housing and one lower housing of the insulating housing 10 and one circuit board (not shown), that is to say, thirteen elements are require to assemble the connector, which is costly in managing and purchasing the elements.

2. The process for assembling the plug 10 is complicated and the first pins 112 and the second pins 113 are easily detached from the tenon 114.

Therefore, the present invention provides an improved structure of a connector having a foldable plug for overcoming the problems described above.

SUMMARY OF THE INVENTION

It is an object of the present invention to provide a structure of a connector having a foldable plug for reducing the assembling elements.

It is another object of the present invention to provide a structure of a connector having a foldable plug and easily manufactured by simple assembly operation so as to reduce the manufacturing cost and time.

In accordance with an aspect of the present invention, there is provided a structure of a connector for connecting a power supply to a power-receiving device. The connector includes an upper housing, a plug, an orientating base, a circuit board and a lower housing. The plug includes a rod and two pins, wherein the rod is connected with the two pins by plastic molding. The upper housing has a plug receptacle in one side thereof and two holes for passing the pins therethrough, wherein the two cavities are disposed in the other side of the pin receptacle and corresponding to the two ends of the rod. The orientating base is a plastic resilience having a first notch for supporting the rod. The circuit board is in contact with the orientating base. The lower housing supports the circuit board and is engaged with the upper housing.

In accordance with another aspect of the present invention, the pins of the plug are electrically connected with the circuit board when the plug is folded to a first position, and the pins are disconnected with the circuit board when the plug is folded to a second position.

Certainly, the connector according to the present invention can be adapted to be used in one selected form a group consisting of an adapter, a charger and an electrical appliance.

Preferably, the first notch is U-shaped.

Preferably, the lower housing further includes a projecting sheet.

Preferably, the projecting sheet is integrally with the lower housing.

Preferably, the circuit board further has an opening corresponding to the projecting sheet for fixing the circuit board.

Preferably, the circuit board further includes two metal sheets corresponding to the ends of the two pins.

Preferably, the orientating base further includes a second notch, and the second notch is U-shaped.

Preferably, the second notch is integrally formed with the first notch.

Preferably, the upper housing further includes a connecting arm corresponding to the second notch.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a cross-sectional view showing the structure of foldable plug in FIG. 1(*a*);

FIG. 2(*b*) is a view illustrating the assembly of the connector in FIG. 2(*a*), wherein the connector is upside-down;

FIG. 4(*b*) is a schematic view illustrating the foldable plug is being adjusted from the first direction to a second position according to the preferred embodiment of the present invention;

FIG. 4(*c*) is a schematic view illustrating the foldable plug is oriented to a second position according to the preferred embodiment of the present invention; and FIG. 4(*d*) is a schematic view illustrating the foldable plug is being adjusted from the second direction to the first position according to the preferred embodiment of the present invention.

DETAILED DESCRIPTION OF THE PREFERRED EMBODIMENT

Figure 1A:
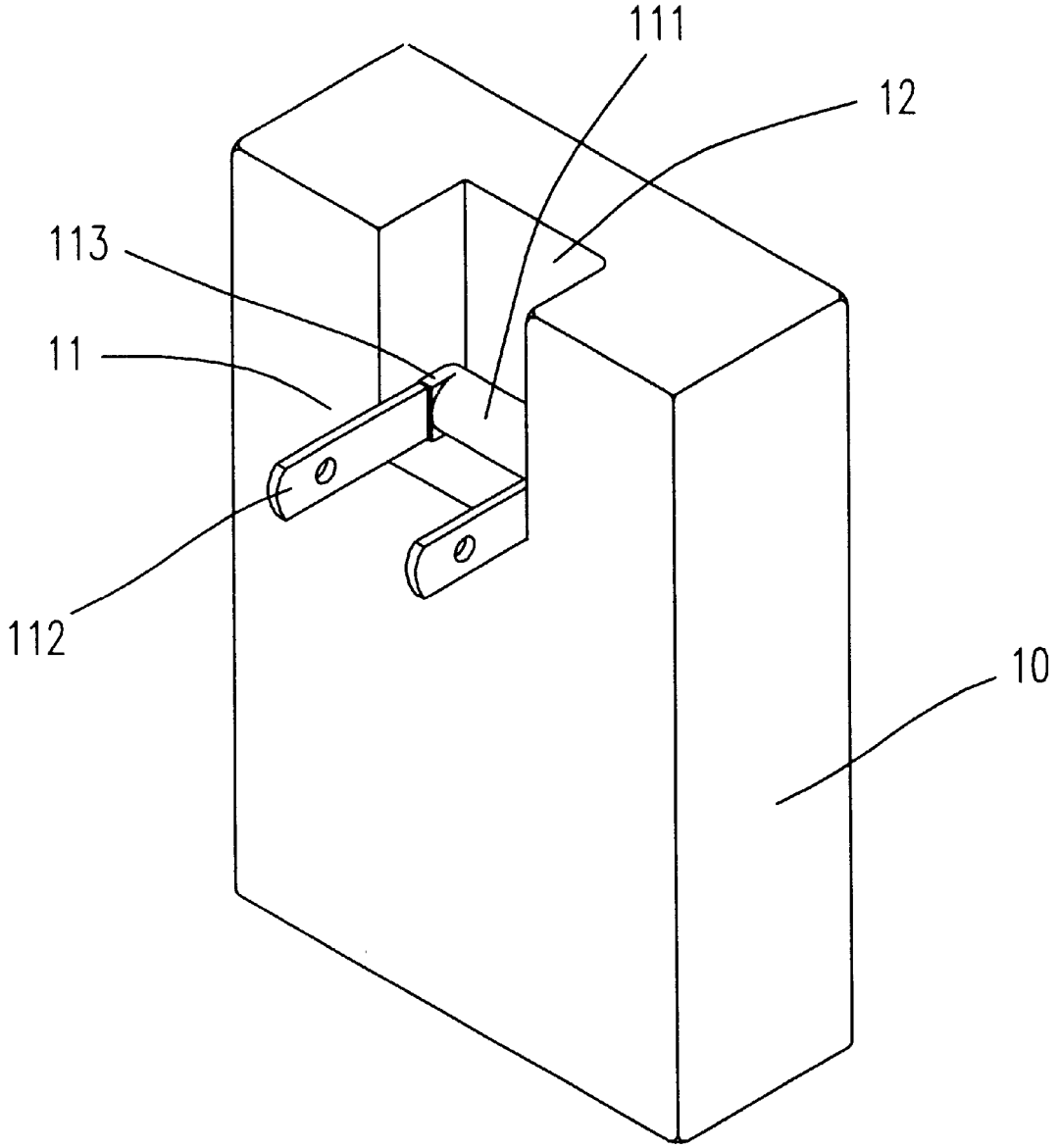
Fig. 1(a)(PRIOR ART)
FIG. 1(*a*) is a perspective view showing a connector having a foldable plug according to prior art.
Figure 1B:
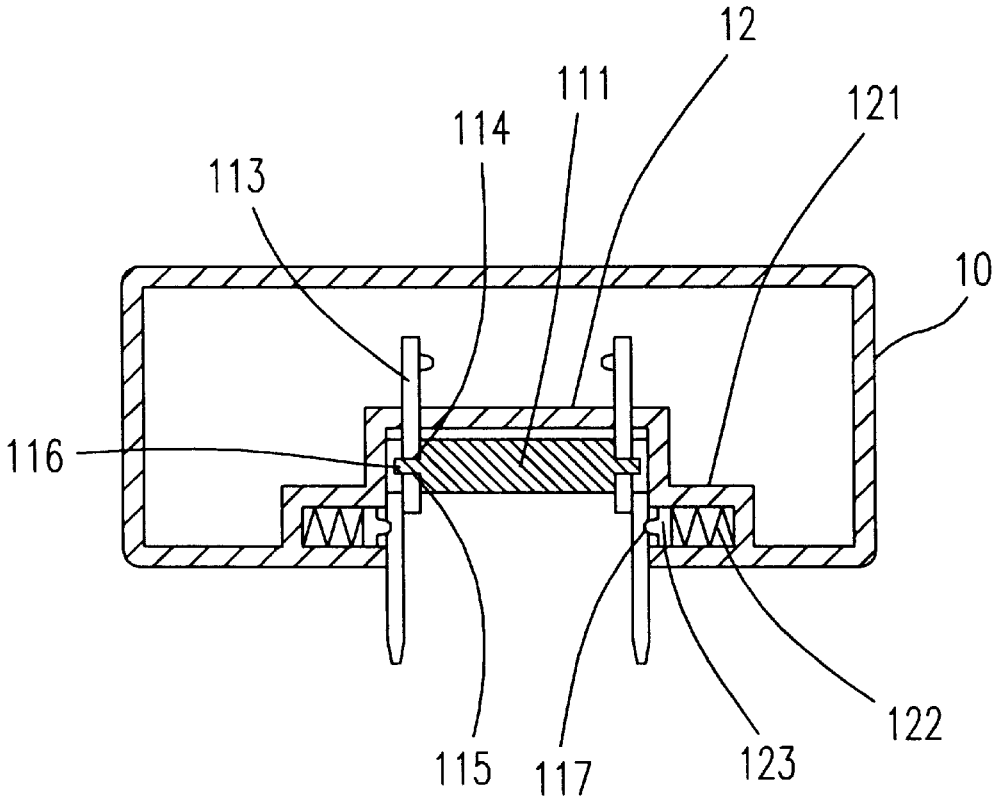
Fig. 1(b)(PRIOR ART)
Figure 2A:
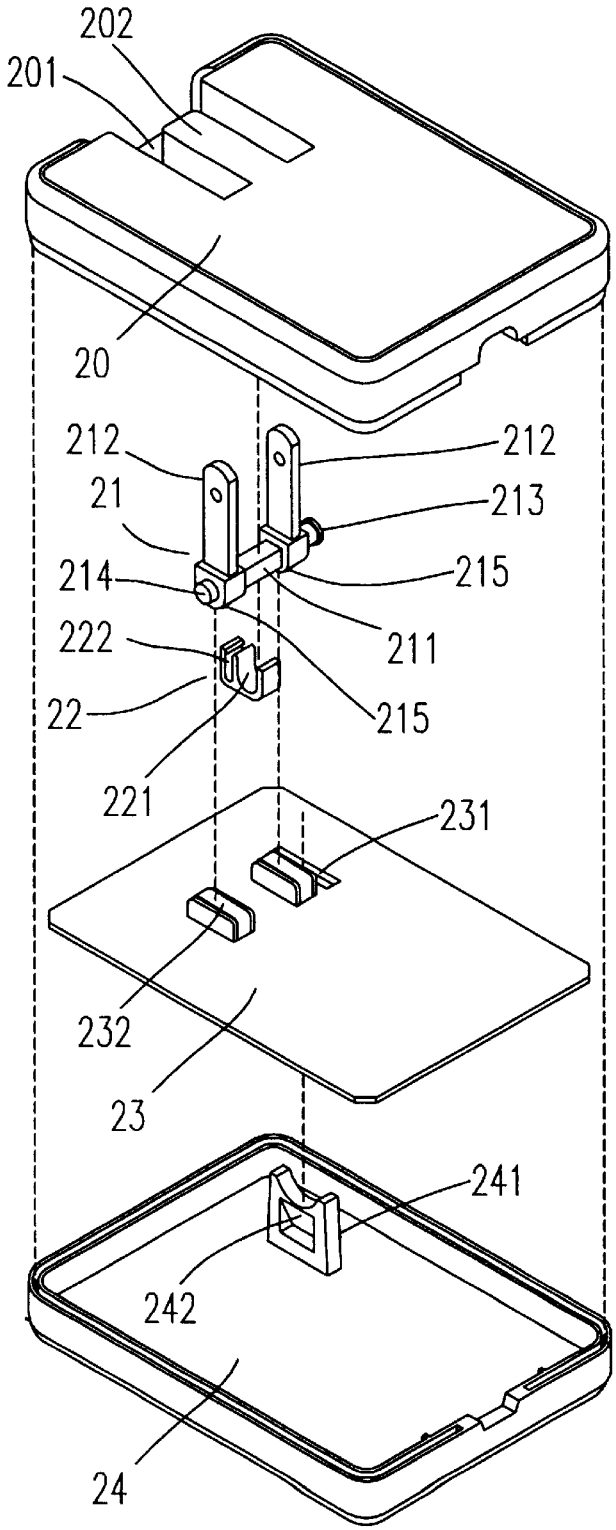
FIG. 2(*a*) is a view illustrating the assembly of the connector having a foldable plug according to a preferred embodiment of the present invention.
Figure 2B:
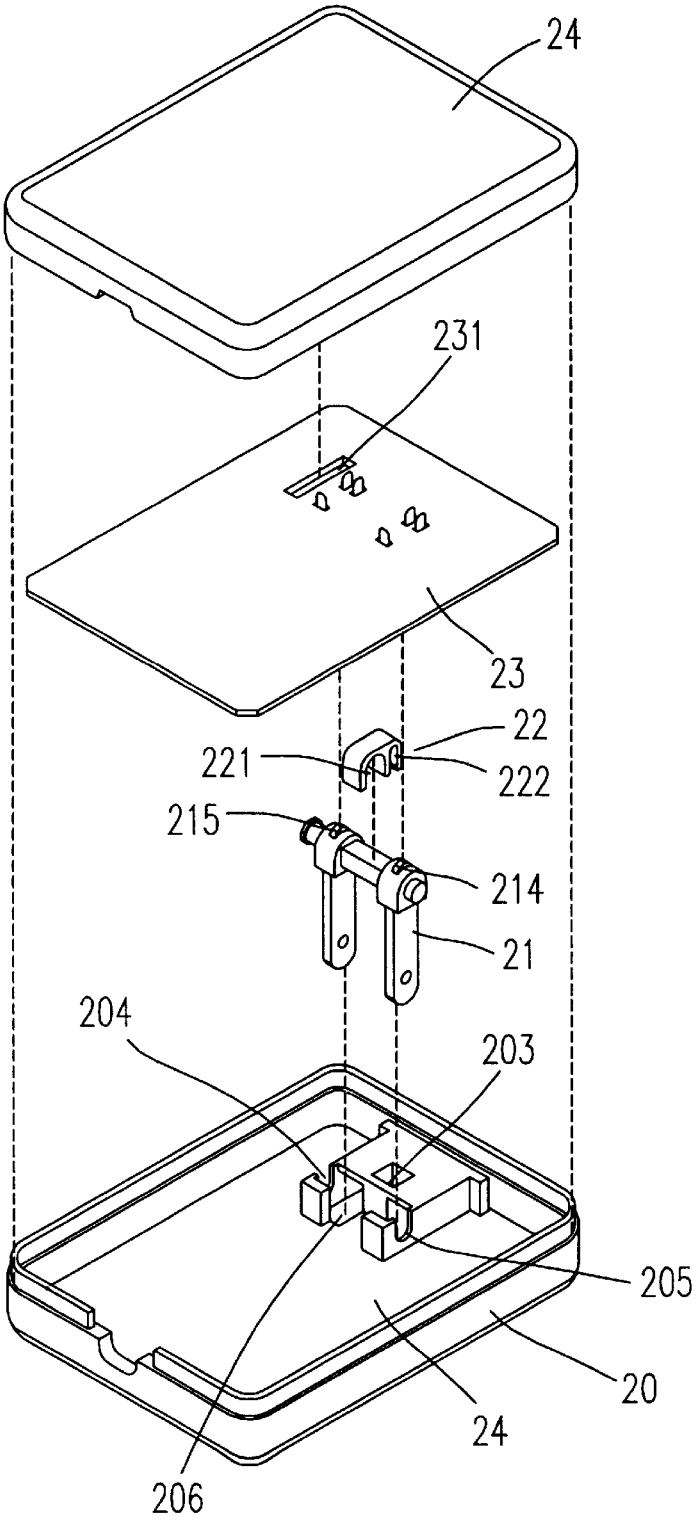
Figure 3:
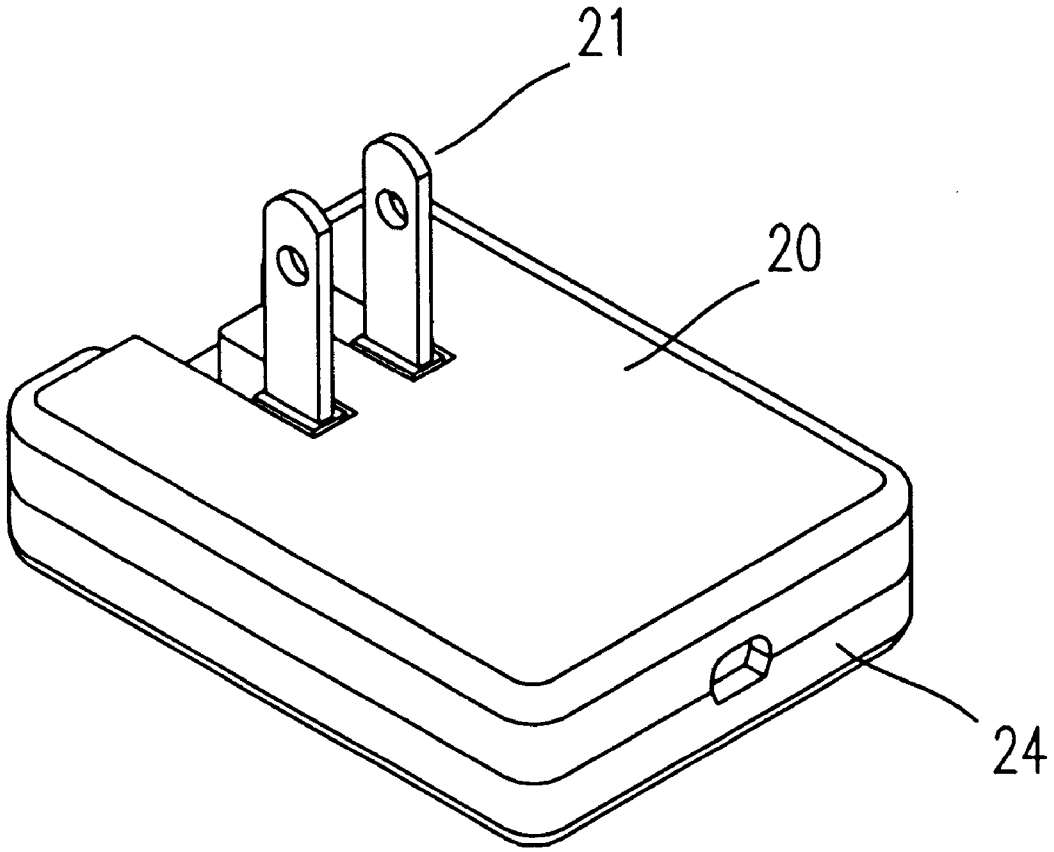
FIG. 3 is a perspective view showing the connector according to the preferred embodiment of the present invention.
Figure 4A:
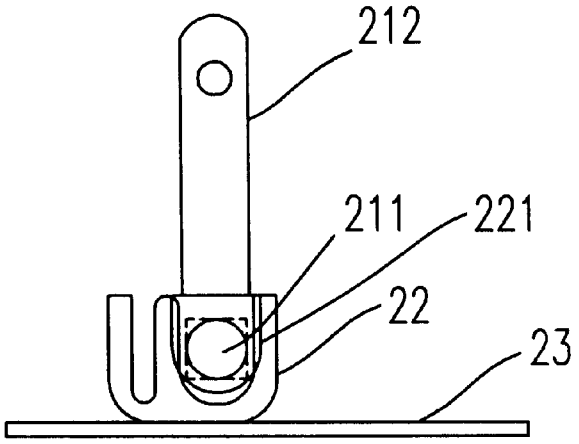
FIG. 4(*a*) is a schematic view illustrating the foldable plug is oriented to a first position according to the preferred embodiment of the present invention.
Figure 4B:
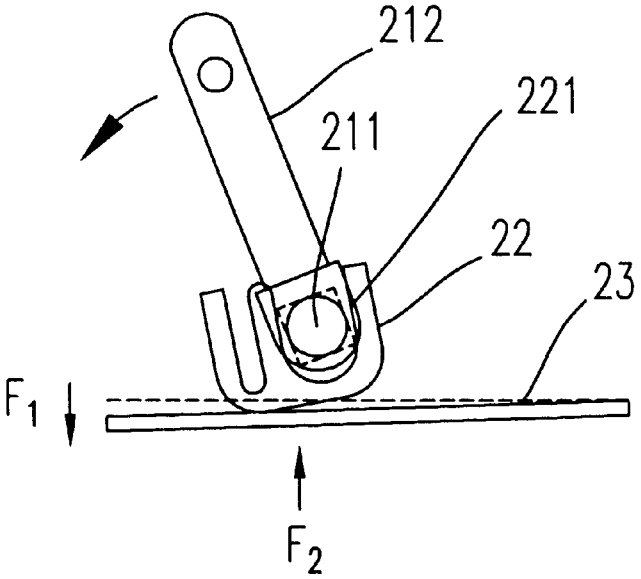
Figure 4C:
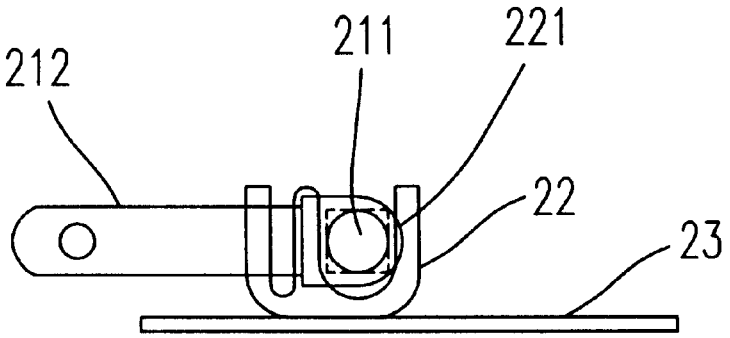
Figure 4D:
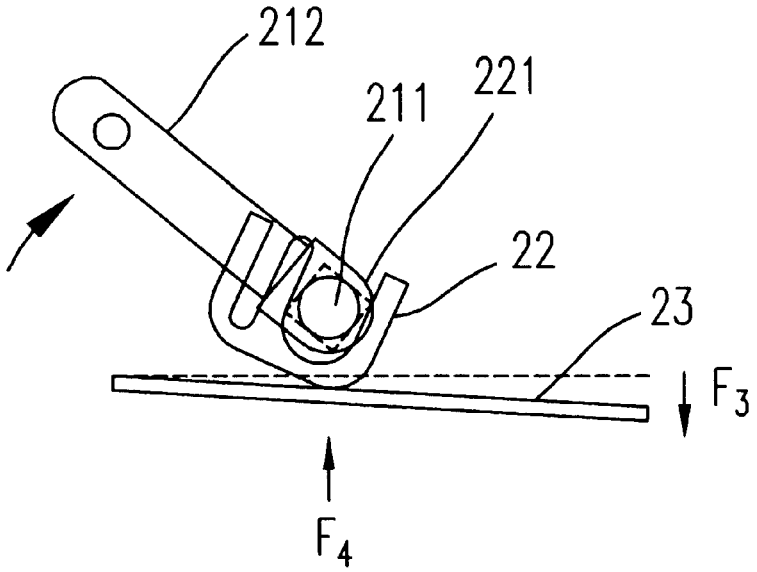

Please refer to FIGS. 2(*a*), 2(*b*) and 3. The connector includes an upper housing 20, a plug 21, an orientating base 22, a circuit board 23 and a lower housing 24. The plug 21 includes a rod 211 and two pins 212. The two pins 212 are connected with the rod 211 by plastic molding. Each of the ends 213 and 214 of the rod 211 is in a shape of cylinder. The upper housing 20 is made of an insulated material and has a plug receptacle 201 in a top edge of one side thereof and two holes 206 for the pins 212 to pass therethrough, wherein a connecting arm 203 and two cavities 204 and 205 are disposed in the opposite side of the plug receptacle 201 and corresponding to the two ends 213 and 214 of the rod 211.

The orientating base 22 is a plastic resilience and prepared by plastic molding. The orientating base 22 in this embodiment includes a first notch 221 corresponding to the rod 211 of the pins 21, and a second notch 222 corresponding to the connecting arm 203. Each of the first notch 221 and the second notch 222 is U-shaped. The first notch 221 is used for supporting the rod 211, and the second notch 222 is mounted on the connecting arm 203 for facilitating the engagement of the rod 211 and the first notch 221.

The circuit board 23 is disposed in the interior side of the lower housing 24. Furthermore, the circuit board has an opening 231 for a projection sheet 241 disposed on the lower housing 24 to pass therethrough, which facilitates the orientation of the circuit board 23 onto the lower housing 24. The lower housing 24 is also made of insulating material. Certainly, the projecting sheet 241 can be integrally formed with the lower housing 24. The top surface of the circuit board 23 is equipped with the customarily used electronic devices and two metal sheets 232 corresponding to the ends 215 of the two pins 212. Subsequently, the lower housing 24 is engaged with the upper housing 20, thereby allowing the circuit board 23 to be in contact with the orientating base 22.

FIGS. 4(*a*) to 4(*d*) are schematic views illustrating the operations of the connector when the plug is folded to different positions according to the present invention. Referring to FIG. 4(*a*), the plug 21 is oriented to a first position, i.e. the pins 212 of the plug 21 are electrically connected with the circuit board 23. Referring to FIG. 4(*b*), the plug 21 is being adjusted from the first direction to a second position (i.e. the plug 21 is received in the receptacle 201 and disconnected with the circuit board 23). Meanwhile, a pressed force F1 is acted on the circuit board 23 and a counterforce F2 is acted to the orientating base 22. When the plug 21 is adjusted to a second position, the forces F1 and F2 could be relieved. Thus, the plug 21 is properly oriented on the second position, as can be seen in FIG. 4(*c*). Referring to FIG. 4(*c*), the plug 21 is being adjusted from the second direction to the first position. Meanwhile, a pressed force F3 is acted on the circuit board 23 and a counterforce F4 is acted to the orientating base 22. When the plug 21 is adjusted to a first position, the forces F3 and F4 could be relieved and the plug 21 is properly oriented on the first position, as shown in FIG. 4(*a*).

The arrangement of the electronic devices and circuit on the circuit board 23 and the operation principle are skilled to the art. It will be understood that the circuit is dependent on the function of the connector, for example, to perform rectification or conversion for a power-receiving device. In accordance with the present invention, the connector could be adapted to be used in one selected from a group consisting of an adapter, a charger and an electrical appliance. When the connector is applied to an adapter, the power-receiving device is an electrical appliance. When the connector is applied to a charger, the power-receiving device is a rechargeable battery. Certainly, the connector of the present invention could be constructed on an electrical appliance, wherein the lower housing 24 is coupled to the cover of the electrical appliance.

As will be apparent from the above description according to the present invention, the structure of the connector has the advantages as follows:

1. The orientating base is used to replace two springs in the prior art owing to its plastic resilience and its good effect on orientating the plug.
2. The orientating base is easily fabricated, which has less manufacturing cost and time.
3. The springs 122 in the prior art always provide resilience force to support the plug, no matter where the plug is folded; however, the orientating base of the present invention provides resilience force to press the circuit board only when the plug is being adjusted form the first position to the second position or from the second position to the first position and the resilience force is relieved when the plug is oriented on the first position or the second position. Therefore, the life of the orientating base according to the present invention has more life than the springs in the prior art.
4. The first pins 112 and the second pins 113 are easily detached from the tenon 114 in the prior art; however, the plug 21 of the present invention is formed by plastic molding for connecting the rod 211 with the pins 212. Therefore, the plug of the present invention could overcome the above drawbacks.
5. Only five elements, i.e. one upper housing 20, one plug 21, one orientating base 22, one circuit board 23 and one lower housing 24 are required to assemble the connector of the present invention, which has more benefits in material management and product yield and less, assembling time and manufacturing cost than those of prior art.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structure.

What is claimed is:

1. A structure of a connector for connecting a power supply to a power-receiving device, comprising:

a plug having a rod and two pins, wherein said rod has two ends is connected with said pins by plastic molding;

an upper housing having first and second sides, a plug receptacle in first side thereof and two holes for passing said pins therethrough, and two cavities disposed in the second side of said upper housing and receiving the two ends of said rod;

an orientating base made of a resilient plastic and having a first notch for supporting said rod;

a circuit board in contact with said orientating base; and a lower housing for supporting said circuit board and being engaged with said upper housing, wherein said pins of said plug are electrically connected with said circuit board when said plug is folded to a first position, and said pins are disconnected with said circuit board when said plug is folded to a second position.

2. The structure according to claim 1, wherein said connector is configured for use in one device selected from the group consisting of an adapter, a charger and an electrical appliance.

3. The structure according to claim 1, wherein said first notch is U-shaped.

4. The structure according to claim 1, wherein said lower housing further comprises a projecting sheet.

5. The structure according to claim 4, wherein said projecting sheet is integrally with the lower housing.

6. The structure according to claim 4, wherein said circuit board further has an opening corresponding to said projecting sheet for fixing said circuit board.

7. The structure according to claim 1, wherein said circuit board further comprises two metal sheets corresponding to the ends of said two pins.

8. The structure according to claim 1, wherein said orientating base further comprises a second notch, and said second notch is U-shaped.

9. The structure according to claim 8, wherein said second notch is integrally formed with said first notch.

10. The structure according to claim 8, wherein said upper housing further includes a connecting arm corresponding to the second notch.

* * * * *